US005082088A

United States Patent [19]

Krause

[11] Patent Number: 5,082,088

[45] Date of Patent: Jan. 21, 1992

[54] CROSS MEMBER CONSTRUCTION FOR USE AT THE FOOT OF LADDERS

[75] Inventor: Günther Krause, Alsfeld, Fed. Rep. of Germany

[73] Assignee: Krause-Werk GmbH & Co. KG, Alsfeld-Altenburg, Fed. Rep. of Germany

[21] Appl. No.: 588,593

[22] Filed: Sep. 26, 1990

[30] Foreign Application Priority Data

Sep. 28, 1989 [DE] Fed. Rep. of Germany ... 8911543[U]
Mar. 2, 1990 [DE] Fed. Rep. of Germany ... 9002470[U]

[51] Int. Cl.[5] ..... E06C 7/44
[52] U.S. Cl. ..... 182/204
[58] Field of Search ..... 182/200–205, 182/107

[56] References Cited

U.S. PATENT DOCUMENTS

| | | | |
|---|---|---|---|
| 2,885,133 | 5/1959 | Nelson | 182/200 |
| 3,908,796 | 9/1975 | Hurwitz | 182/201 |
| 3,937,298 | 2/1976 | Hurwitz | 182/200 |

*Primary Examiner*—Reinaldo P. Machado
*Attorney, Agent, or Firm*—Flynn, Thiel, Boutell & Tanis

[57] ABSTRACT

A cross member construction for use at the foot of ladders having a cross bar fastened to the sidepieces of the ladder and extending laterally outwardly from both side edges thereof. In order to be able to safely set up the ladder on a ground surface having a great disparity in levelness, a support element is fastened to at least one end area of the cross bar to extend the effective length of the cross bar, which support element has an elevationally adjustable support arm thereon.

16 Claims, 3 Drawing Sheets

CROSS MEMBER CONSTRUCTION FOR USE AT THE FOOT OF LADDERS

FIELD OF THE INVENTION

The invention relates to a cross member construction for use at the foot of ladders comprising a cross bar fastenable to the sidepieces of the ladder.

BACKGROUND OF THE INVENTION

A plurality of uses for ladders or ladder elements is known from the state of the art, where the ladder or the ladder element is equipped with additional, supplementing structural elements so that special demands for each use can be met. An important problem in the design of ladders is the reliable setting up or placing of the ladder or of the ladder element. If a ladder is supposed to be utilized on a level, solid ground, problems with respect to setting the ladder up do not exist. Since, however, common use of the ladder requires it to be able to be set up on uneven ground, for example in order to carry out repairs on the outside of a house in order to maintain the outside or for other purposes, it is necessary to design the lower area of the ladder so that it is variable or adjustable in order to facilitate a setting up of the ladder in the vertical direction and to eliminate the risk of tipping. Similar problems exist when ladders must be set up on stairs, for example in order to paint staircases. It is known from the state of the art to provide the sidepieces of the ladder with suitable extensions in order to support, for example, one sidepiece on a lower step while the other sidepiece rests on the next higher step. However, the design of such a ladder is disadvantageous for specific applications, because the ladder stands on the two sidepieces, namely, the support distance corresponds with the distance between the sidepieces. In particular, in the case of a long ladder, there exists the danger that the ladder tilts laterally if it is set up slightly inclined or if the operator bends to the left or right of the central longitudinal axis of the ladder. In order to overcome this disadvantage, a cross member is known which can be fastened to the lower end of the sidepieces of the ladder. The cross member is wider than the distance between the sidepieces so that, as a whole, a safe support results. It is thereby disadvantageous that an adaptation to different heights is possible, or only a limited possibility, in the case of such a cross member since the cross member is usually fastened to the sidepieces of the ladder by means of a clamping device and must be positioned inclined at an angle with respect to the crosspieces of the ladder in order to compensate for an uneven ground. Such inclined positions, in turn, require a corresponding play of the clamping device or an inclined installation of the clamping device. This is not possible, or is only a limited possibility, for structural reasons, since the known cross member can compensate only for small differences in height.

SUMMARY OF THE INVENTION

The basic purpose of the invention is to provide a cross member construction for a ladder which, with a simple design and simple, reliable handling, enables a compensation for great disparities in levelness and height of the ground support are for the ladder.

The purpose is attained according to the invention by the capability of fastening a support element to at least one end region of a cross bar in order to extend the cross bar laterally, which support member has an elevationally adjustable support arm thereon.

The foundation for a cross member construction for use on ladders embodying the invention is distinguished by a number of significant advantages.

Since the additional support element which is adjustable relative to the cross bar has an elevationally adjustable support arm, the ladder can also be set up in areas having very large disparities in levelness and height. It is thereby particularly important that the cross member construction itself not be adjustable relative to the sidepieces of the ladder so that it is possible to fasten same reliably to the sidepieces of the ladder and to use thereby other clamping or connecting devices, by means of which an exact alignment of the cross member construction is assured. With this adjustment capability, it is particularly assured that unintended incorrect operations of the cross member construction will not occur and that erroneous ladder set ups in an inclined relation, that is, laterally inclined, will also not occur.

The foundation of the invention includes an extension of the cross member construction on at least one edge of the ladder, thus achieving a particularly safe support.

A particularly favorable design of the invention provides that the support member is constructed like a substantially straight bar, on the free end of which is arranged a support arm. This design enables the use of common, usually extruded profiles and moreover enables the fabrication of the cross member construction such that even an unskilled operator can immediately check the safe handling aspects and the functional aspects of the set up. This is made significantly easier by a straight design of the individual elements, since twistings or the like are not necessary and/or need not be feared.

It is furthermore advantageous according to the invention when the support element can be adjustably positioned and fastened to the cross bar by means of a clamping device. A varying width of the cross member construction can be particularly easily realized with this measure, on the other hand, a reliable guiding of the support element on the cross bar of the cross member construction is assured. Furthermore, it is possible to utilize a simple clamping device which, on the one hand, can be manufactured inexpensively and, on the other hand, offers a high degree of reliability in operation. Since the support element and the cross bar are arranged parallel to one another, the forces occurring during use of the ladder do not result in a shifting of the support element relative to the cross bar since the forces are applied substantially perpendicularly with respect to the longitudinal axis of the support element and thus of the cross bar.

In order to be able to use the cross bar also without the additional support elements and support arms, the cross bar has a wider width than the distance between the pair of sidepieces on the ladder. It furthermore opens up the possibility of fastening the respective support element to the free end of the cross bar so that the area between the sidepieces does not need to be influenced or occupied by additional fastening devices or the like. Thus, the operator can move on the ladder without any danger because he will not step or get caught on fastening devices. It is furthermore guaranteed thereby that the operator will not unintentionally with his foot release the clamping or fastening devices.

A particularly favorable and advantageous type of the clamping device is designed such that same includes an upper and a lower clamping element, each having a U-shaped cross section and being drawn toward one another by means of a screw connection. The clamping elements thus grip around both the cross bar and also the support element and prevent thereby a shifting of the two elements in their longitudinal direction. In addition, both the support element and also the cross bar are mounted so that a lateral slipping is impossible.

The support arm utilized to compensate for unlevel support surface conditions is constructed substantially rectilinearly in an advantageous development of the invention and is mounted by means of a guide part fastened on the respective free end of the support element. The support arm is thereby preferably enclosed by a pipe-shaped guide part, so that introduction of force from the support arm onto the support element is safely guaranteed. The support arm must, to adjust the level, merely be moved relative to the guide part. This is a measure which can be taken by an untrained operator without resulting in operating or safety problems.

In addition to widening the stance of the ladder through the support elements supported on the cross bar, a further enlargement of the distance between the support points is possible by the support arm extending laterally at the lower end. This modification has furthermore the advantage that a load on the ladder results in a canting of the support arm so that same is additionally secured against a movement relative to the guide part. Thus, and in addition to the clamping action produced by the guide screw, a locking of the support arm occurs.

The support arm has at its lower end preferably a support boot which consists, for example, of a rubber-like material in order to prevent a slipping on smooth surfaces. However, it is also possible to design the support boot in its form such that a slipping is prevented, for example, by providing a tip or the like movable into the ground.

In order to be able to manufacture the cross member construction of the invention utilizing the simplest initial elements, it is provided that the cross bar, the support element and the support arm have substantially the same hollow rectangular cross section. It is thereby possible to utilize standard dimensions and to fall back on standardized additional elements, for example shields or the like.

To safely connect the guide part with the support arm, the invention provides that the guide part has a hole to guide the locking screw therethrough, that the support arm has an elongated slot therein and that inside of the support arm there is arranged a nut, which nut is in engagement with the locking screw and is fixed against rotation. The position of the locking screw is thus predetermined by the hole in the guide part, just like the position of the nut fixed against rotation. The elongated slot enables a movement of the support arm along the guide part and assures at the same time a more reliable and simpler clamping ability.

In order to use the cross member construction also when the support elements have been removed, the cross bar has in a favorable development at the outer ends of both cross bars a support boot. Furthermore, it is favorable to fasten the cross bar by means of a clamping device which enables the cross bar to be elevationally adjustable relative to the sidepieces of the ladder in order to assure a variable adaptability of the cross member construction to the ladder.

It can furthermore be advantageous according to the invention to provide in addition to the clamping action of the locking screw a positive locking feature. Same can be designed such that on the inner side of the support arm, which inner side opposes the locking screw, there are constructed locking recesses for receiving the free end of a threaded part of the locking screw. The locking recesses can be formed in a perforated bar arranged on the support arm. It is furthermore advantageous when the length of the threaded part is determined such that at a maximum clamping action between a washer and the guide part, the free end of the threaded part extends to a location closely adjacent an inside facing wall of the support arm.

BRIEF DESCRIPTION OF THE DRAWINGS

The invention will be described hereinafter in connection with one exemplary embodiment and the drawings, in which.

DETAILED DESCRIPTION

Figure 1:
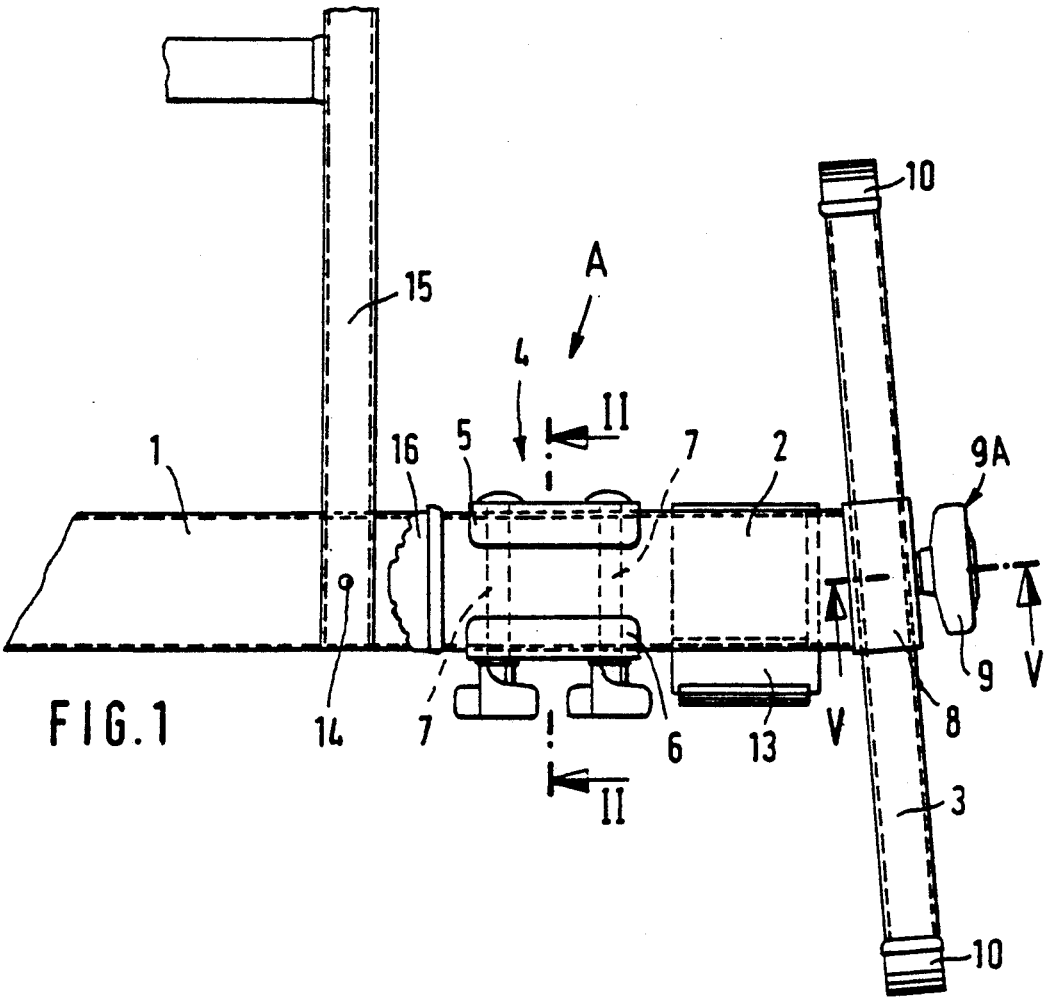
FIG. 1 is a schematic side view of a partial area of a cross member construction for use on ladders embodying the invention.
Figure 3:
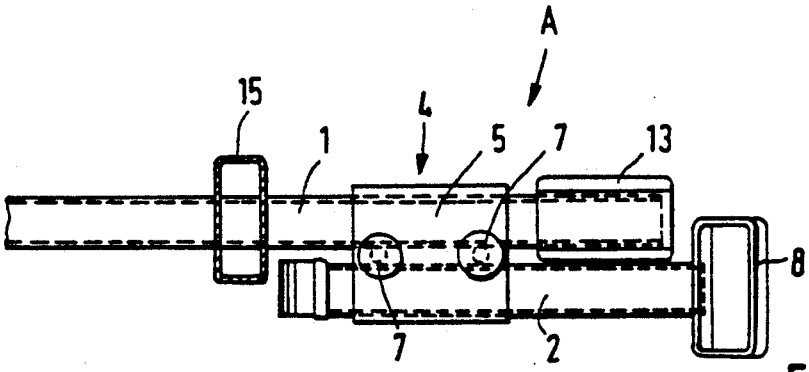
FIG. 3 is a top view of the arrangement shown in FIG. 1, with the support arm being removed.

FIGS. 1 and 3 each show only a lower region of one of a pair of sidepieces 15 of a ladder. The ladder is designed in the usual manner utilizing metallic hollow profiles.

Figure 2:
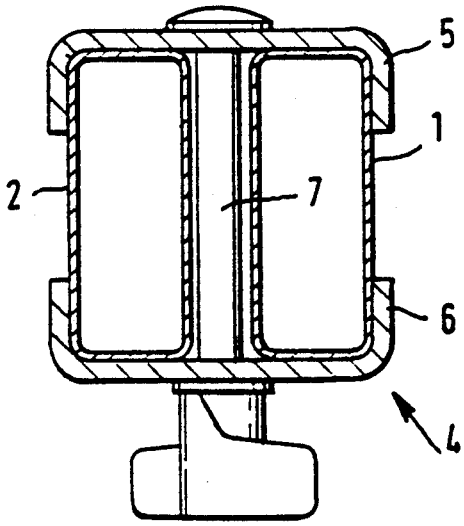
FIG. 2 is a cross-sectional view taken along the line II—II of the clamping device of the invention.

A cross member construction A embodying the invention includes a cross bar 1 fastened to the lower end of each of the two sidepieces 15 by means of a clamping device 14, which clamping device is only schematically illustrated in FIG. 3. The clamping device 14 can include, for example, a clamping jaw and a suitable screw connection. The cross bar 1 has, just like the sidepiece 15, a substantially rectangular hollow profile and is manufactured of an extruded metal material (see FIG. 2). A support boot 13 is mounted on the free right end of the cross bar 1, which free end is oriented laterally outside of the spacing between the pair of sidepieces 15. The support boot 13 serves at the same time as a protective shield.

A support element 2 is supported according to the invention parallel to the cross bar 1 on a free end of the cross bar 1 such that the support element is movable parallel to the cross bar 1. A clamping device 4, which will be described in detail hereinafter, is used according to the invention to fix the support element 2 on the bar 1. FIGS. 1 and 3 each illustrate only one half of the cross member construction of the invention, it being understood that same is designed symmetrically, namely, that it is provided on both lateral sides of the ladder.

The clamping device 4 of the invention, by means of which the support element 2, which has the same cross section as the cross bar 1 (see FIG. 2), can be connected to the cross bar 1, includes an upper clamping element 5 and a lower clamping element 6. The two clamping elements 5, 6 have each a U-shaped cross section. A screw connection 7 extends through the clamping elements. The two clamping elements 5, 6 can be drawn toward one another by means of the screw connection to clamp the cross bar 1 and support element 2 therebetween, so that a movement of the support element relative to the cross bar is prevented. The U-shaped design of the clamping elements 5, 6 in addition assures also a lateral guiding of the support element 2 on the cross bar 1. FIG. 3 shows that two screw connections 7 are preferred.

A guide part 8 is arranged on the free end of the support element 2, which guide part is of a hollow pipe-shaped design and is dimensioned such that a rectilinear support arm 3 can be supported freely movably in the guide part 8. The support arm 3 has at each of its upper and its lower ends a support boot 10 and is held by means of a locking screw 9 in the respective vertically selected position on the guide part 8. The locking screw 9 will be described hereinafter in detail in connection with FIGS. 4 and 5.

In order to reduce the risk of possible injuries, the end of the support element 2 which is adjacent the ladder has a cap 16 thereon.

Figure 4:
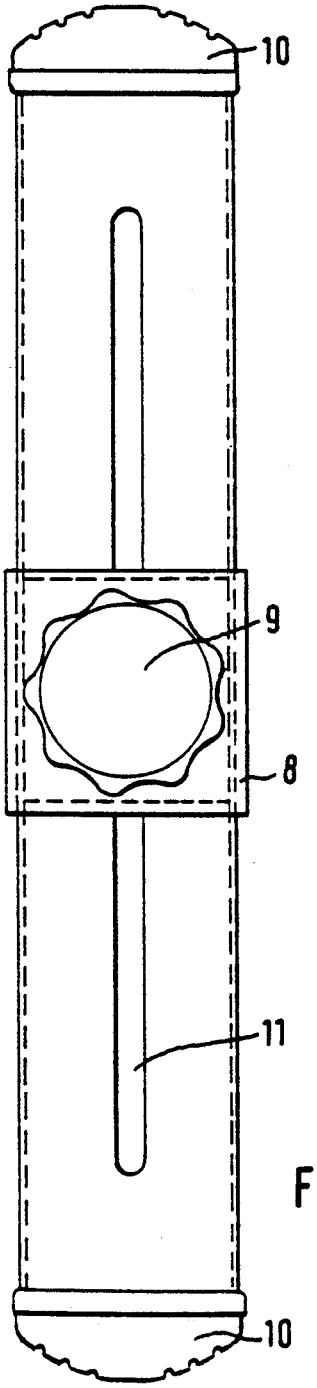
FIG. 4 is a view of the side of the device, which side is the right side in FIG. 1.
Figure 5:
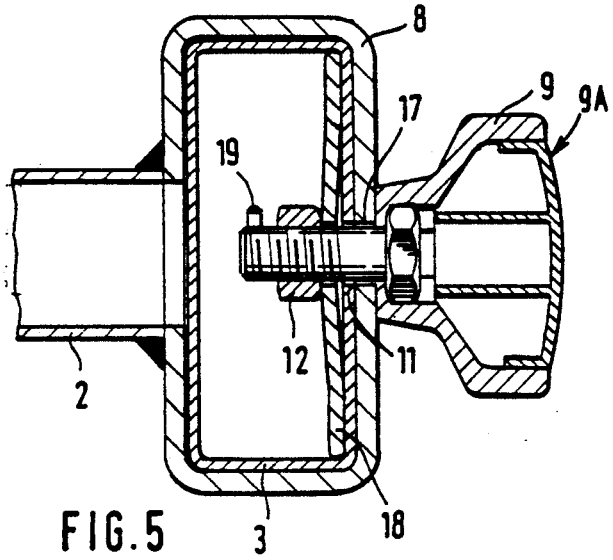
FIG. 5 is a cross-sectional view of the guide part taken along the line V—V of FIG. 1.

FIGS. 4 and 5 illustrate the mechanism of the invention, with the help of which the support arm 3 is fixed on the support element 2. The support arm 3 has an elongated slot 11 extending lengthwise thereof on its one side, through which slot is guided the locking screw 9 into the inside of the support arm 3. The guide part 8 has furthermore a hole 17 therein. Thus, it is possible to move the support arm 3 in longitudinal direction relative to the guide part 8, with the locking screw 9 remaining stationary since it is guided through the hole 17 in the guide part 8. A substantially rectangular washer 18 is arranged inside of the support arm 3, to which washer is connected a nut 12. The nut 12 is threadedly engaged with the locking screw 9. The washer 18 helps to lock the nut 12 against rotation and assures that the locking screw 9 can be tightened without requiring additional, further tools or operations. In order to prevent a complete unscrewing of the locking screw 9, an abutment 19, for example, in the form of a wire bar, is provided at an end of the screw which is inside of the support arm 3 and remote from a handle 9A at its opposite end.

Figure 6:
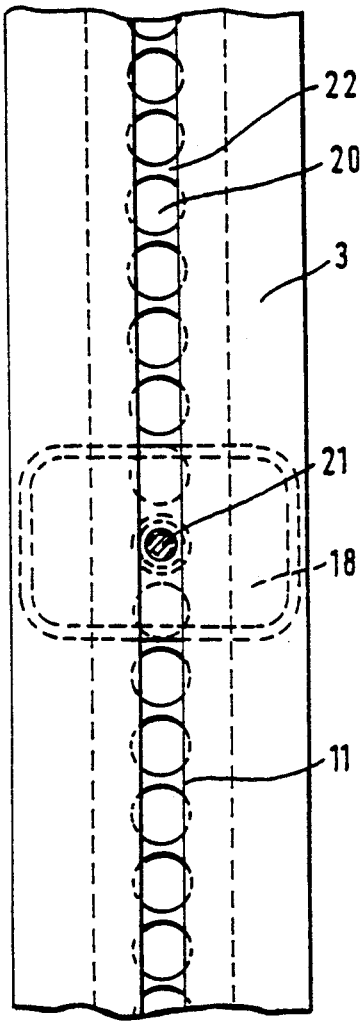
FIG. 6 is a simplified side view of a further exemplary embodiment of the support arm of the invention.
Figure 7:
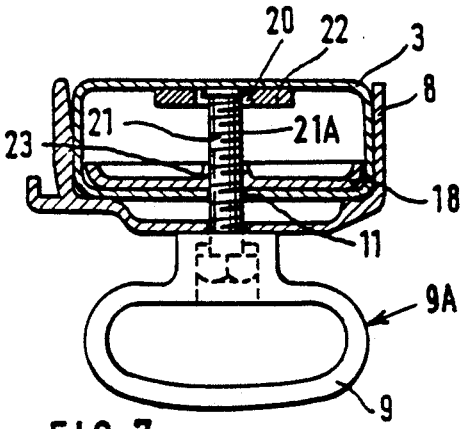
FIG. 7 is a cross-sectional view of the exemplary embodiment illustrated in FIG. 6.

FIGS. 6 and 7 show a further exemplary embodiment for fastening the support arm 3 on the guide part 8. The same parts have the same reference numerals. The support arm 3, like in the previous exemplary embodiment, has an elongated slot 11 therein and can be clamped by means of the locking screw 9. The external thread 21 of the locking screw 9 is screwed into an internally threaded hole 23 of the washer 18. The length of the externally threaded part 21A of the screw has a longer length compared with the earlier shown exemplary embodiment. A bar 22 is mounted on the inside of the support arm 3, which bar has locking recesses 20 therein. The locking recesses 20 can be seen in the side view of FIG. 6. FIG. 6 shows a row or arrangement of such locking recesses 20 on the bar 22. Thus, a fine adjustment of the support arm 3 relative to the guide part 8 is possible. The length of the threaded part 21 is such that the free end of the part extends at a maximum clamping action between the washer 18 and the guide part 8 to a location closely adjacent an inside facing wall of the support arm 3.

In the exemplary embodiment illustrated in FIGS. 6 and 7, it is possible after releasing the locking screw to cancel the clamping action between the guide part 8 and the washer. This is done by slightly unscrewing the externally threaded part 21A. Due to its length, however, the free end of the externally threaded part 21A continues to be in the corresponding locking recess 20 so that an unintended movement of the support arm 3 relative to the guide part 8 is prevented. Only after the externally threaded part 21 has been further unscrewed does the free end thereof leave the locking recess 20 so that a movement of the support arm 3 relative to the guide part 8 becomes possible. The locking screw is tightened in an analogous manner. Thus, in addition to the force-locking mounting provided by the engagement of the washer 18 with an inside facing wall of the support arm 3, a positive locking of the support arm 3 on the guide part 8 is also guaranteed by the receipt of the free end of the part 21A into a selected recess 20.

Thus, it is possible according to the invention to adjust the width of the cross member construction A to the respective requirements by moving the support elements 2 relative to the cross bar and, at the same time, to align the ladder by elevationally adjusting the support arm 3 so that the ladder can be set into a vertical alignment on a ground surface having great disparities in levelness. The clamping device 4 enables a movement or fixing of the support elements 2, while the locking screw 9 facilitates the elevational adjustment of the support arm 3.

The embodiments of the invention in which an exclusive property or privilege is claimed are defined as follows:

1. A cross member construction for use adjacent the foot of ladders having at least a pair of sidepieces, wherein a cross bar is fastenable to the sidepieces of the ladder, wherein a support element is selectively positionably fastened on at least one end area of the cross bar to laterally extend said support element laterally beyond the end of said cross bar, which support element has an elevationally adjustable support arm thereon.

2. The cross member construction according to claim 1, wherein the support element is designed like a substantially straight bar, on the free end of which is arranged the support arm.

3. The cross member construction according to claim 1, wherein the support element is selectively positionably fastened on the cross bar by means of a clamping device.

4. The cross member construction according to claim 1, wherein the cross bar has a greater width than the distance between the sidepieces of the ladder so that the support element can be fastened on the free end of the cross bar laterally of the sidepiece.

5. The cross member construction according to claim 3, wherein the clamping device includes an upper and a lower clamping element having a U-shaped cross section, with the clamping elements being drawn toward one another by means of a screw connection.

6. The cross member construction according to claim 2, wherein the support arm is designed substantially rectilinearly and is supported movably in a guide part fastened on the free end of the support element.

7. The cross member construction according to claim 6, wherein the guide part is designed in a hollow pipe-shaped form and includes a locking screw.

8. The cross member construction according to claim 6, wherein the support arm extends laterally away from the sidepieces at the lower end.

9. The cross member construction according to claim 2, wherein the support arm has a support boot at its lower end.

10. The cross member construction according to claim 2, wherein the cross bar, the support element and the support arm have substantially the same rectangular cross section.

11. The cross member construction according to claim 6, wherein the guide part has a hole therein to guide a locking screw therethrough, wherein the support arm has a slotted hole therein, and wherein inside of the support arm there is arranged a nut, which nut is in engagement with the locking screw and is locked against rotation.

12. The cross member construction according to claim 1, wherein the cross bar has a support boot on opposite ends thereof.

13. The cross member construction according to claim 1, wherein the cross bar includes clamping means for elevationally adjustably fastening the cross bar to the sidepieces of the ladder.

14. The cross member construction according to claim 11, wherein plural locking recesses for receiving the free end of a threaded part of the locking screw are provided on the inner side of the support arm, which inner side opposes the locking screw 15. The cross member construction according to claim 14, wherein the locking recesses are formed by a perforated bar arranged on the support arm.

16. The cross member construction according to claim 14, wherein the length of the threaded part is determined such that at a maximum clamping action between a washer and the guide part, the free end of the threaded part extends to a location closely adjacent the inner side of the support arm.

* * * * *